US011317666B2

(12) United States Patent
Moore et al.

(10) Patent No.: US 11,317,666 B2
(45) **Date of Patent: *May 3, 2022**

(54) WAISTBAND FOR ARTICLE OF APPAREL FEATURING CORD AND EMBROIDERY TUNNEL

(71) Applicant: NIKE, Inc., Beaverton, OR (US)

(72) Inventors: Bruce Y. Moore, Laguna Beach, CA (US); Erika K. Anaya, Costa Mesa, CA (US)

(73) Assignee: NIKE, Inc., Beaverton, OR (US)

( * ) Notice: Subject to any disclaimer, the term of this patent is extended or adjusted under 35 U.S.C. 154(b) by 4 days.

This patent is subject to a terminal disclaimer.

(21) Appl. No.: 16/990,731

(22) Filed: Aug. 11, 2020

(65) Prior Publication Data

US 2020/0367586 A1 Nov. 26, 2020

Related U.S. Application Data

(60) Division of application No. 15/915,469, filed on Mar. 8, 2018, now Pat. No. 10,779,593, which is a continuation of application No. 14/657,549, filed on Mar. 13, 2015, now Pat. No. 9,943,126.

(51) Int. Cl.
*A41F 9/00* (2006.01)
*A41F 9/02* (2006.01)

(52) U.S. Cl.
CPC . *A41F 9/00* (2013.01); *A41F 9/02* (2013.01)

(58) Field of Classification Search
CPC .... A41F 9/00; A41F 9/02; A41F 9/002; A41F 9/025; A41F 1/008; A41D 1/08; A41D 2300/33; A41D 7/005; A41D 2200/10; A41D 2300/332; A61F 5/02; A61F 5/028
USPC ... 2/236, 237, 107, 219, 220, 221, 235, 238, 2/307, 318, 319, 76, 105–112; 602/19
See application file for complete search history.

(56) References Cited

U.S. PATENT DOCUMENTS

| | | | |
|---|---|---|---|
| 76,871 | A | 4/1868 | Wolfsbruck |
| 464,826 | A | 12/1891 | Isaac |
| 503,520 | A | 8/1893 | John |

(Continued)

FOREIGN PATENT DOCUMENTS

| | | | |
|---|---|---|---|
| CA | 2065348 | C | 5/1998 |
| CN | 1258202 | A | 6/2000 |

(Continued)

OTHER PUBLICATIONS

Intention to Grant received for European Patent Application No. 18199957.4, dated Oct. 6, 2021, 8 pages.

*Primary Examiner* — F Griffin Hall
(74) *Attorney, Agent, or Firm* — Shook, Hardy & Bacon L.L.P.

(57) ABSTRACT

A waistband for an article of apparel comprising at least one embroidery tunnel is provided. The waistband comprises at least one cord comprising a first and second end affixed to the waistband, and an intervening portion movably coupled to the waistband with stitches that form the embroidery tunnel, the embroidery tunnel configured to distribute a tensioning force applied to the cord across at least a portion of the waistband. The embroidery tunnel forms a series of parallel courses across the waistband, with the cord able to move freely within the embroidery tunnel.

20 Claims, 7 Drawing Sheets

(56) References Cited

U.S. PATENT DOCUMENTS

| | | | | |
|---|---|---|---|---|
| 898,511 | A * | 9/1908 | Schneider | A41D 1/21 2/221 |
| 1,499,647 | A | 7/1924 | Annie | |
| 1,561,712 | A | 11/1925 | Hugo | |
| 1,825,271 | A | 9/1931 | Karberg | |
| 2,072,020 | A * | 2/1937 | Barmon | A41D 1/22 2/221 |
| 2,849,773 | A | 9/1958 | Kaselow | |
| 5,351,340 | A | 10/1994 | Aldridge | |
| 5,375,266 | A | 12/1994 | Crisco | |
| 5,758,519 | A | 6/1998 | Joyce et al. | |
| 6,199,215 | B1 | 3/2001 | Biggerstaff | |
| 6,286,341 | B2 | 9/2001 | Jackson et al. | |
| 6,342,044 | B1 | 1/2002 | Frangi et al. | |
| 8,409,122 | B2 | 4/2013 | Cropper et al. | |
| 8,429,762 | B2 | 4/2013 | Weisman | |
| 8,555,419 | B2 | 10/2013 | Harvey et al. | |
| 2002/0099345 | A1 | 7/2002 | Saito et al. | |
| 2004/0172848 | A1 | 9/2004 | Hirayama | |
| 2010/0275344 | A1 | 11/2010 | Demarest et al. | |
| 2011/0041359 | A1 | 2/2011 | Dojan et al. | |
| 2012/0036614 | A1 | 2/2012 | Meschter et al. | |
| 2013/0007947 | A1 | 1/2013 | Moore et al. | |
| 2015/0152578 | A1 | 6/2015 | Darby | |
| 2016/0262478 | A1 | 9/2016 | Moore et al. | |
| 2018/0192721 | A1 | 7/2018 | Moore et al. | |

FOREIGN PATENT DOCUMENTS

| | | | |
|---|---|---|---|
| CN | 2587378 | Y | 11/2003 |
| CN | 2730420 | Y | 10/2005 |
| CN | 203789179 | U | 8/2014 |
| FR | 2576611 | A1 | 8/1986 |
| GB | 402334 | | 11/1933 |
| JP | 2000-273701 | A | 10/2000 |

* cited by examiner

WAISTBAND FOR ARTICLE OF APPAREL FEATURING CORD AND EMBROIDERY TUNNEL

CROSS-REFERENCE TO RELATED APPLICATIONS

This application is a divisional of co-pending U.S. patent application Ser. No. 15/915,469, filed Mar. 8, 2018, titled "Waistband for Article of Apparel Featuring Cord and Embroidery Tunnel," which is a continuation of U.S. patent application Ser. No. 14/657,549, filed Mar. 13, 2015, titled "Waistband for Article of Apparel Featuring Cord and Embroidery Tunnel," now issued as U.S. Pat. No. 9,943,126. Each of the aforementioned applications is incorporated herein by reference in the entirety.

TECHNICAL FIELD

The present disclosure relates to a waistband for an article of apparel. More specifically, the present disclosure relates to a waistband that comprises at least one cord secured to the waistband by an embroidery tunnel formed from a plurality of threads stitched to the waistband through which the cord can move, the embroidery tunnel configured to transfer a tensioning force to the waistband.

BACKGROUND

A traditional waistband for an article of apparel such as board shorts often incorporates a drawstring waistband to secure the article to the wearer. Drawstring waistbands frequently utilize one or more cords traveling through and around the article. The cord can often be drawn or tightened to increase pressure on the waistband and reduce the circumference of the waistband, thereby securing the waistband to the wearer. A drawstring waistband is less bulky than a waistband featuring traditional securement components like snaps, hooks, or zippers. However, drawstring waistbands have a number of disadvantages including weak securement, minimal distribution of tensioning force across the waistband, strain on the waistband that weakens the waistband structures, and wearer discomfort.

BRIEF SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects described herein relate to a waistband comprising at least one cord having a first end secured to the waistband at a first location, a second end secured to the waistband at a second location, and an intervening portion movably secured to an inner or outer surface of the waistband. As used throughout this disclosure, the term "cord" refers to any wire including flywire, cable, lanyard, binding, braid, string, strip, tape, tie, ligature, line, link, ribbon, rope, stay, strap, or similar structure that can support a tensioning force applied axially to the cord. The cord may comprise natural or man-made fibers, including synthetic fibers, an example of which would be nylon. Additionally, the cord may have stretch or non-stretch properties. The intervening portion may be movably secured to the waistband with a securing element such as stitching, the securing element forming an embroidery tunnel that secures the cord to the waistband while permitting the cord to move within the embroidery tunnel in a direction parallel to the axial direction of the embroidery tunnel. The ends of the cords may be secured to the waistband with a secondary backing.

The securing element may comprise stitches, filaments, yarns, or thread which can be used to sew a pattern onto a base material. The base material may be an outer layer of the waistband, with securing element backing located between the outer layer and an inner layer of the waistband. The embroidery tunnel may form a series of parallel courses on the waistband. The parallel courses may be parallel to the top and bottom edges of the waistband and/or parallel to each other. The stitches may further comprise a plurality of tack-downs coupled to the stitches to prevent unraveling of the embroidery tunnel. The term "tack-down" as used in this disclosure means a component attached to an embroidery to prevent unraveling of the embroidery should the stitching used to form the embroidery become weakened, cut, compromised, or otherwise unsecured. Each embroidery tunnel may be continuous along the length of the intervening portion of the cord, and the embroidery tunnels may form a series of parallel courses, or channels, along all or part of the waistband inner or outer surface. The embroidery tunnels permit a tensioning force applied to the cord to be distributed evenly across at least a portion of the waistband. Each embroidery tunnel may form any number of arrangements and configurations, and may be separate or intermingled with other embroidery tunnels, and may feature one or many turns. Any and all such variations and any combination thereof are contemplated as being within the scope herein.

In one exemplary aspect, a cord may be secured to the waistband by stitches forming an embroidery tunnel. Each end of the cord may be affixed to the same end or opposite ends of the waistband. The intervening portion of the cord may be stitched to the waistband, the stitches forming an embroidery tunnel. The embroidery tunnel may form parallel courses or channels, and the courses may be parallel to the top edge and the bottom edges of the waistband. The cord first end may be affixed to one end of the waistband, and the cord second end may be affixed to the opposite end of the waistband. The embroidery tunnel may follow any number of paths or configurations across the waistband, featuring one or many turns or changes in direction.

In another aspect, two cords may be stitched to the waistband with the stitching configured to form separate embroidery tunnels. A first cord may be secured to the waistband with the first cord first end and the first cord second end affixed to the first end of the waistband at a first and second location, respectively. A second cord may be secured to the waistband second end, the second cord first end and the second cord second end affixed to the second end of the waistband at a first and second location, respectively. The intervening portion of each cord may be stitched continuously to the waistband so that the stitching forms two distinct embroidery tunnels for the first and second cords, the embroidery tunnels configured to transfer a tensioning force applied to each cord across at least a portion of the waistband. The first and second ends of each cord may also be affixed to the first and second ends of the waistband, respectively. In other words, each cord has the ends affixed to opposite ends of the waistband.

In another exemplary aspect, a lanyard or tie is coupled to the first and second ends of the waistband to allow the wearer to transfer a tensioning force from the lanyard or tie to each cord and subsequently to the waistband. The lanyard may be connected to each of the waistband ends through one or more couplings, each coupling connection comprising an eyelet, aperture, linkage, or other mechanical connection. One or more of the embroidery tunnels may partially or completely circumscribe the eyelet or couple to the eyelet to allow a tensioning force to be transferred between the lanyard and the cord, and subsequently to the waistband. The size of the cord, the material from which the cord is produced, the amount and length of the stitching used to form the embroidery tunnels, the number and orientation of the embroidery tunnels through which the intervening portion of the cord travels, and the way in which the tensioning force is transferred between the coupling and the cord may be varied for desired effect, as would be understood by one having ordinary skill in the art. Additionally, the distribution of the tensioning force across the waistband can be varied or optimized for the waistband based on the number and arrangement of courses provided by the one or more embroidery tunnels.

BRIEF DESCRIPTION OF THE DRAWINGS

The present invention is described in detail herein with reference to the attached drawing figures, wherein.

DETAILED DESCRIPTION

Figure 1:
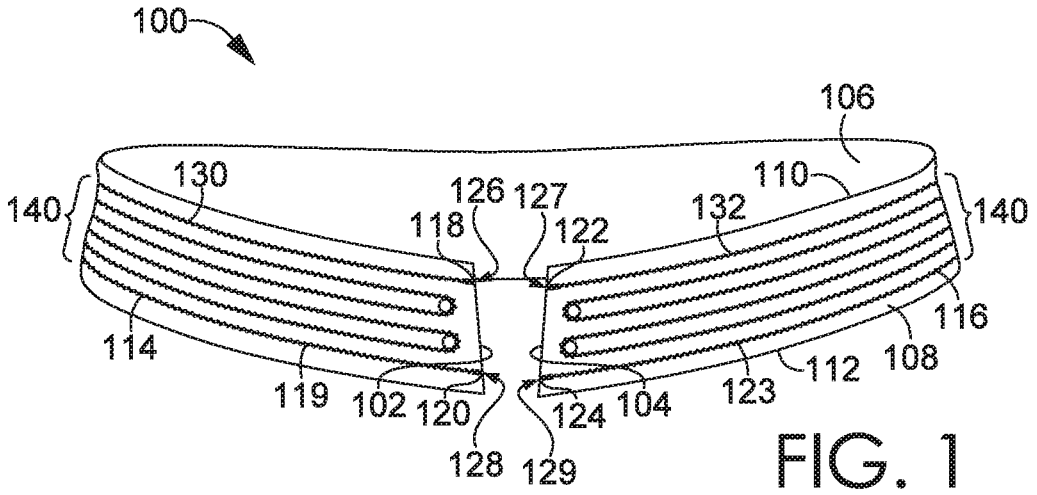
FIG. 1 depicts a front elevation view of the waistband featuring at least one embroidery tunnel movably affixing at least one cord to the waistband, in accordance with an aspect hereof.

Aspects herein provide for an article of apparel that comprises a waistband featuring at least one cord affixed at one or both ends of the waistband, and an intervening portion of the cord stitched to the waistband, the stitches configured to form an embroidery tunnel across at least a portion of the waistband. The waistband material may comprise a textile or woven stretch fabric suited for securing stitches, or that is suited for using stitch backing that can properly support stitching on the waistband material. The waistband may be formed from an inner layer and an outer layer affixed to each other, the stitch backing located between the two layers to prevent abrasion against the wearer of the article. Each cord comprises first and second ends and an intervening portion. The intervening portion of each cord may be movably coupled to the inner or outer surface of the waistband with one or a plurality of securing elements, one example being stitches. The stitches may be used to couple the intervening portion of the cord to the waistband, the stitches configured to form one or more embroidery tunnels on the inner or outer surface of the waistband. Each embroidery tunnel secures the cord and simultaneously allows the cord to move within the embroidery tunnel in a direction parallel to the axial direction or path of the embroidery tunnel. The waistband may further comprise a coupling component connected to the first end and/or second end of the waistband to allow a tensioning force applied to the coupling to be transferred to the cord, and subsequently transferred to at least a portion of the waistband. Because of the configuration of the embroidery tunnels, the tensioning force is evenly distributed over the extent of the waistband, thereby improving wearer comfort and fit.

In one exemplary aspect, a single cord is secured to the waistband via a single embroidery tunnel extending across at least a portion of the waistband. The cord first end may be securely affixed to the waistband first end, and the cord second end may be securely affixed to the waistband second end. The intervening portion of the cord may be movably secured or coupled to the outer surface of the waistband using a plurality of embroidery stitches. The plurality of embroidery stitches may be separated or continuous across the intervening portion of the cord, and may take a variety of alternating patterns or arrangements. The plurality of embroidery stitches may form embroidery tunnels that are substantially continuous from the cord first end to the cord second end, or in other words, substantially continuous along the intervening portion of the cord. The embroidery tunnel may allow the cord to move within the tunnel in either direction parallel to the axial direction of the embroidery tunnel. The embroidery tunnel may comprise a plurality of turns and may form parallel courses across at least a portion of the waistband. The parallel courses may run back and forth, and may be parallel to the bottom edge and the top edge of the waistband.

In another exemplary aspect, two cords may be stitched to the waistband, the stitches configured to form two separate embroidery tunnels on an inner or outer surface of the waistband. In one such example, a first cord and a second cord are used, each cord having a first end, a second end, and an intervening portion. The first cord first and second ends may be securely affixed to the waistband at first and second locations, respectively, the first and second locations corresponding to the first and second ends of the first cord. The intervening portion of the first cord may be movably affixed to the inner or outer surface of the waistband with a plurality of embroidery stitches, the embroidery stitches forming a first embroidery tunnel, the first embroidery tunnel configured to allow the first cord to move within the tunnel in either direction parallel to the axial direction of the first embroidery tunnel. The second cord first and second ends may be securely affixed to the waistband second end at a first and second location, respectively, the first and second locations corresponding to the first and second ends of the second cord. The intervening portion of the second cord may be movably affixed to the inner or outer surface of the waistband with a plurality of embroidery stitches, the embroidery stitches forming a second embroidery tunnel, the second embroidery tunnel configured to allow the second cord to move within the tunnel in either direction parallel to the axial direction of the second embroidery tunnel. The first and second ends of the cords may be secured to ends of the waistband with secondary bartacks, for added securement.

The tunnels may be arranged on the waistband in any number of ways. The tunnels may comprise a plurality of turns forming different paths or courses over a portion of the waistband. The tunnels may be arranged such that they form parallel channels or courses, the parallel channels or courses also may be parallel to the top and bottom edges of the waistband. The first and second tunnels may be arranged on distinct portions of the waistband with the courses not intermingled. In one such arrangement, a first tunnel may be positioned on a first half of the waistband measured from the waistband first end to a point halfway across the waistband. The second tunnel may be positioned on a second half of the waistband, the second half of the waistband measured from the waistband second end to the point halfway across the waistband. There may be a dividing portion between the first and second embroidery tunnels, the dividing portion containing no embroidery stitches or tunnels.

The embroidery tunnels may be configured or constructed in any number of ways. The tunnels may movably contain each cord using one long continuous stitch, a plurality of separate stitches, or a combination of stitches and other securing components. Separate stitches may be arranged closely or in spaced configuration. The tunnels may further comprise a plurality of tack-downs spaced intermittently between the stitching. The tack-downs may comprise a tightly wound bunching or grouping of stitches that are sufficiently secured to prevent unraveling of the embroidery tunnel should a stitch become weakened, frayed, cut, or otherwise dislodged or displaced. Other commonly known embroidery tack-downs for apparel may also be used to achieve the same effect. The ends of the embroidery tunnels may further be secured using a secondary bartack machine. This secondary bartack secures the ends of the embroidery tunnels and the cords therein in a fixed position on the waistband.

A top edge of the waistband may also be folded over and bonded, stitched, or otherwise secured to the inner or outer surface of the waistband to partially cover the embroidery course and form a smooth edge on the waistband. For example, the top edge can be folded over to cover the portion of the embroidery tunnel forming a top course on the outer surface of the waistband. In such an aspect, no tack-downs are required for the portion of the embroidery tunnel covered by the folded edge of the waistband, as the folded and secured portion will prevent unraveling of the embroidery courses.

The waistband may be formed from two layers of material, a first outer layer and a second inner layer, each layer having respective inward and outward facing sides. The embroidery may be stitched to the outer layer of waistband, with the embroidery on the outward facing side of the outer layer, and corresponding embroidery backing on the inward facing side of the outer layer. Because the embroidery backing can be abrasive against the wearer of the article, the second inner layer is coupled, stitched, glued, or otherwise bonded to the first outer layer partially or wholly across the waistband cross section to provide a softer surface against the wearer of the article when the article is in an as-worn position.

In the following figures, the article of apparel and the waistband are depicted in accordance with different aspects of the present invention. The articles depicted herein are only a few examples of suitable articles and are not intended to suggest any limitation as to the scope of use or functionality of the invention. For example, although shorts are depicted in the figures, it is contemplated that the apparel item may further comprise pants, capris, and the like. Neither should the articles be interpreted as having any dependency or requirement relating any one or combination of elements or characteristics illustrated therein. Although some elements are shown in the singular, they may be plural. Additionally, although some elements are depicted as plural in occurrence, in actuality, they may be singular. This is true for the description of these elements throughout this entire disclosure.

Looking at FIG. 1, a front elevation view of a waistband 100 is shown, in accordance with an aspect hereof. As shown in FIG. 1, the waistband 100 comprises a first end 102 and a second end 104, a waistband inner surface 106, a waistband outer surface 108, a waistband top edge 110, and a waistband bottom edge 112. The waistband 100 may comprise a woven or knit elastic material, stretchable textile material, or any other material that is suitable for securing stitching. A first cord 114 is affixed to the waistband first end 102 at a first location 118 and a second location 120. More specifically, a first end 126 of the first cord 114 is affixed to the waistband first end 102 at the first location 118, and a second end 128 of the first cord 114 is affixed to the waistband first end 102 at the second location 120, the cord first end 126 and cord second end 128 secured with secondary bartacks 154 (shown in FIG. 2). A second cord 116 is affixed to the second end 104 at a first location 122 and a second location 124. More specifically, a first end 127 of the second cord 116 is affixed to the waistband second end 104 at the first location 122, and a second end 129 of the second cord 116 is affixed to the waistband second end 104 at the second location 124. The first cord 114 is movably coupled to the waistband 100 with stitches 130. The second cord 116 is movably coupled to the waistband 100 with stitches 132. The ends of the first cord 126, 128 and the ends of the second cord 127, 129 may be affixed to the waistband ends 102, 104 such that they are securely attached and remain fixed when tension is applied to the waistband 100 or the cords 114, 116. The ends of the first cord 126, 128 and the ends of the second cord 127, 129 may be affixed to the waistband 100 by stitching or other mechanical securement, gluing, bonding, heat-treating, or otherwise affixing the cord ends 126, 127, 128, 129 such that they resist movement forces and remain in position on the waistband 100.

Figure 2:
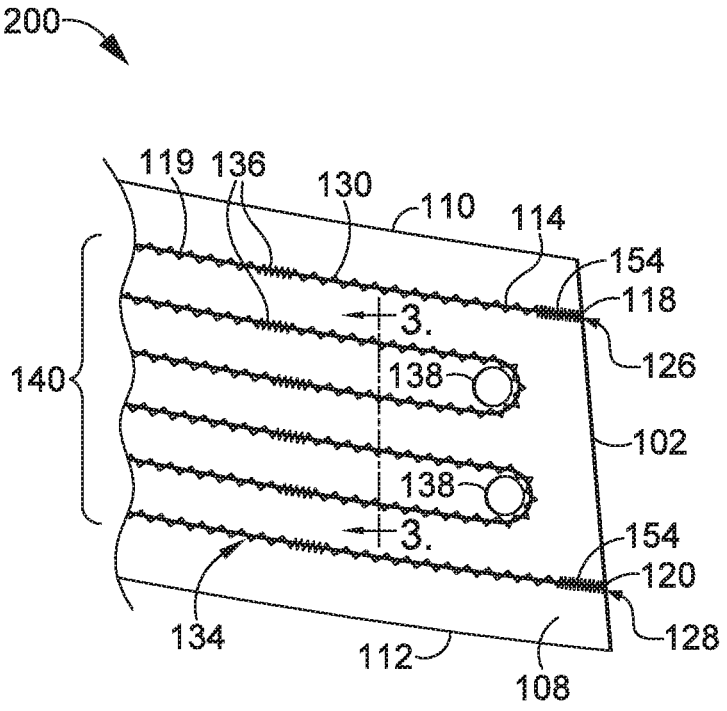
FIG. 2 depicts a close-up cut-off view of the waistband first end featuring the at least one embroidery tunnel of FIG. 1, in accordance with an aspect hereof.

Looking at FIG. 2, a close-up view 200 of the waistband first end 102 is shown, in accordance with an aspect hereof. As shown in FIG. 2, the waistband outer surface 108 comprises a first cord 114 affixed to the waistband outer surface 108 at a first location 118 and a second location 120. The first location 118 corresponds with the first cord first end 126, and the second location 120 corresponds with the first cord second end 128, the first cord first end 126 and the first cord second end 128 secured to the waistband 100 with secondary bartacks 154. A similar arrangement holds true for the second cord 116. Between the first cord first end 126 and the first cord second end 128 is an intervening portion 119 of the first cord 114, the intervening portion 119 movably coupled to the outer surface 108 of the waistband 100 by the plurality of stitches 130, the stitches 130 forming a first embroidery tunnel 134 through which the first cord 114 can move in a direction parallel to the axial direction of the embroidery tunnel 134. In FIG. 2, the embroidery tunnel 134 shown on the waistband first end 102 is continuous from the first location 118 to the second location 120. In other words, the embroidery tunnel 134 does not contain any gaps, breaks, or interruptions between the first location 118 and the second location 120. The outer surface 108 also comprises eyelets 138 extending through the thickness of the waistband material. A lanyard can be threaded through the eyelets 138 to transfer a tensioning force to the first cord 114 as shown more clearly, for example, with respect to FIG. 5. The first cord 114 is shown as looped around or partially circumscribing each eyelet 138 such that it can receive a tensioning force applied to the eyelets 138. A number of tack-downs 136 are used on the first embroidery tunnel 134 to prevent unraveling of the stitches 130. The first embroidery tunnel 134 is located on the outer surface 108 of the waistband 100 and forms a plurality of parallel courses 140, as seen in FIG. 2. The parallel courses 140 are located between the top edge 110 of the waistband 100 and the bottom edge 112 of the waistband 100, and are substantially parallel to each other.

Figure 3:
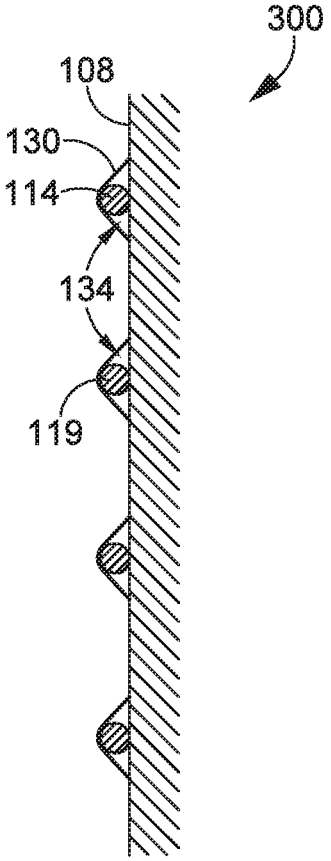
FIG. 3 depicts a cross-sectional view of the waistband taken from line 3-3 of FIG. 2 showing the cord and stitches forming the embroidery tunnel on an outer surface of the waistband, in accordance with an aspect hereof.

Looking at FIG. 3, FIG. 3 illustrates a cross-sectional view 300 of the waistband 100 taken along cut line 3-3 of FIG. 2. FIG. 3 depicts the first cord 114 and stitches 130 movably affixing the first cord 114 to the outer surface 108 of the waistband 100, the stitches 130 forming the first cord embroidery tunnel 134 on the outer surface 108 of the waistband 100 in accordance with an aspect hereof. The stitches 130 overlay the first cord 114 to form the first embroidery tunnel 134 while permitting the first cord 114 to slide through the embroidery stitching 130 in a direction parallel to the embroidery tunnel 134.

Figure 4:
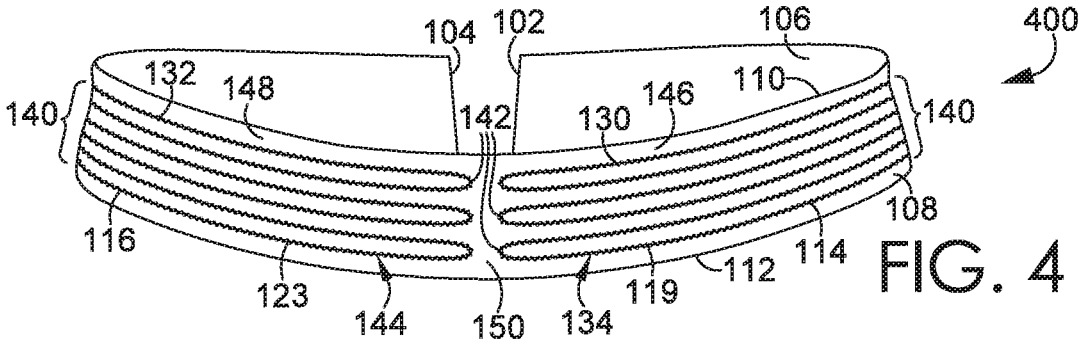
FIG. 4 depicts a rear elevation view of the waistband of FIG. 1, in accordance with an aspect hereof.

Looking at FIG. 4, a rear elevation view 400 of the waistband 100 is shown, in accordance with an aspect hereof. The first cord 114 and second cord 116 are shown movably coupled to the outer surface 108 of the waistband 100 using first cord stitches 130 and second cord stitches 132, the first cord stitches 130 forming the first embroidery tunnel 134 containing the first cord 114, and the second cord stitches 132 forming the second cord embroidery tunnel 144 containing the second cord 116. The first embroidery tunnel 134 and second embroidery tunnel 144 each forms the plurality of substantially parallel courses 140 between the waistband top edge 110 and the waistband bottom edge 112. In the configuration shown in FIG. 4, the first cord 114 covers an area of the outer surface 108 of the waistband 100 that is approximately one half the distance around the length of the waistband 100 from the first end 102 and comprises a first half 146 of the waistband 100. The second cord 116 covers an area of the waistband outer surface 108 that is approximately half the distance around the length of the waistband 100 from the second end 104 and comprises the second half 148 of the waistband 100. The plurality of parallel courses 140 on the first half 146 and second half 148 of the waistband 100 are separated by a dividing portion 150. As shown, the dividing portion 150 is free of any embroidery tunnels. In other words, the embroidery tunnel 134 and the embroidery tunnel 144 do not cross the dividing portion 150 in this aspect. The first cord embroidery tunnel 134 and the second cord embroidery tunnel 144 each have a plurality of turns 142 that act to separate the plurality of parallel courses 140 from each other and act to prevent the embroidery tunnels 134 and 144 from crossing the dividing portion 150.

Figure 5:
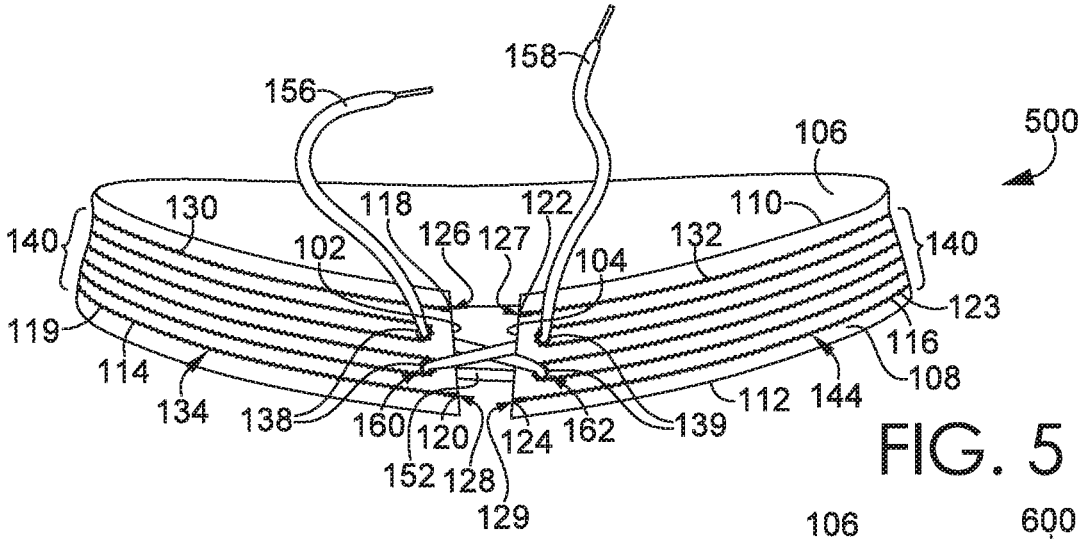
FIG. 5 depicts a front elevation view of the waistband of FIG. 1 illustrating the at least one embroidery tunnel and a lanyard coupled to ends of the waistband, in accordance with an aspect hereof.

Looking at FIG. 5, a front elevation view 500 of the waistband 100 including embroidery tunnels 134, 144 and a lanyard 152 coupled to ends 102, 104 of the waistband 100 is shown, in accordance with an aspect hereof. The waistband first end 102 comprises first cord eyelets 138 through which the lanyard 152 can be threaded to transfer a portion of a tensioning force applied to the lanyard 152 to the first cord 114 when the wearer pulls on the lanyard first end 156. The waistband second end 104 comprises second cord eyelets 139 through which the lanyard 152 can be threaded to transfer a portion of the tensioning force applied to the lanyard 152 to the second cord 116 when the wearer pulls on the lanyard second end 158. The first embroidery tunnel 134 loops around or partially circumscribes the first cord eyelets 138 on the waistband outer surface 108 to provide a securing arrangement for the first cord eyelets 138 and allow the tensioning force to be transferred from the first cord eyelet 138 to the first cord 114. The second embroidery tunnel 144 loops around or partially circumscribes the second cord eyelets 139 on the waistband outer surface 108 to provide a securing arrangement for the second cord eyelets 139 and allow the tensioning force to be transferred from the second cord eyelets 139 to the second cord 116. Although only two eyelets are shown in association with the first and second ends 102 and 104, it is contemplated herein that there may be more than two eyelets or less than two eyelets in association with the first and second ends 102 and 104.

Figure 6:
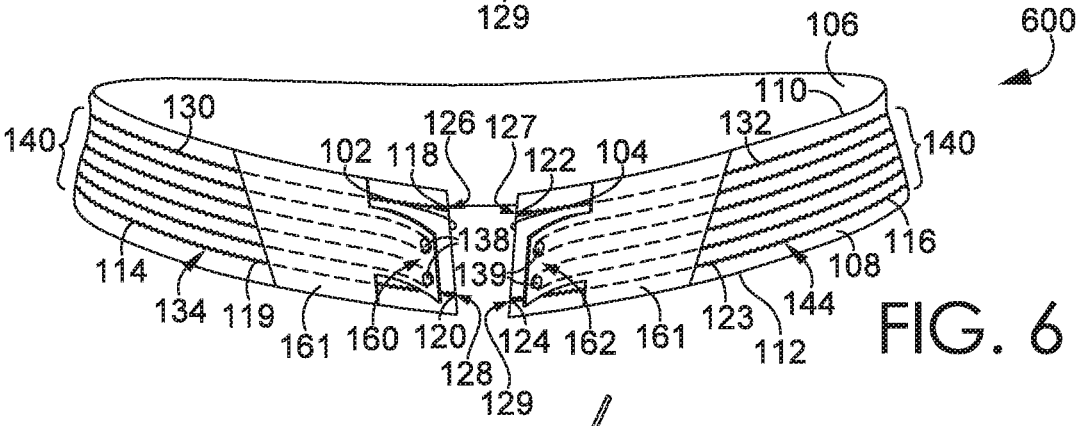
FIG. 6 depicts a front elevation view of the waistband of FIG. 1 comprising the at least one embroidery tunnel and an exemplary first and second coupling through which a tensioning force can be transferred to the waistband, in accordance with an aspect hereof.

Looking at FIG. 6, a front elevation view 600 of the waistband 100 including embroidery tunnels 134, 144, an exemplary first cord coupling 160, and an exemplary second cord coupling 162 are shown, in accordance with an aspect hereof. The couplings 160, 162 may be formed as separate components and coupled to the waistband 100. The separate components may be fabric or textile sections coupled to the waistband 100 with adhesive, bonding, stitching, hook-and-loop fasteners, and the like. The couplings 160, 162 may also be formed as an integrated part of the waistband 100, with the couplings 160, 162 extending from the outer surface 108 of the waistband 100. In either configuration, the cords 114, 116 may pass through the respective couplings 160, 162 to integrate the cords 114, 116 with the couplings 160, 162, allowing a tensioning force to be transferred from the couplings 160, 162 to the cords 114, 116, respectively, and subsequently to at least a portion of the waistband 100. In an alternative configuration, the couplings 160, 162 may also comprise a cut-out of the waistband 100, the cut-out forming an aperture or other attachment component through which a force transferring element, such as a lanyard 152, can be coupled. The couplings 160, 162 and cords 114, 116 contained therein may also be further secured to the waistband 100 with fabric overlays 161 which cover the embroidery tunnels 134, 144 over and proximate to the couplings 160, 162. The fabric overlays protect the cord structures around the couplings 160, 162, which prevents degradation of the materials, due to the couplings 160, 162 being a high wear area. The fabric overlays 161 are presented in FIG. 6 with the cords 114, 116 beneath as dotted lines.

In FIG. 6, the first coupling 160 is configured to receive a tensioning force from the wearer of the waistband 100 and transfer the tensioning force to the first cord 114, and the second coupling 162 is configured to receive a tensioning force from the wearer of the waistband 100 and transfer the tensioning force to the second cord 116. The first cord coupling 160 is affixed proximate to the waistband first end 102 and the second cord coupling 162 is affixed proximate to the waistband second end 104. As shown in FIG. 6, a further embodiment of the couplings 160, 162 may comprise first cord eyelets 138 and second cords eyelets 139 extending through the thickness of each coupling 160, 162, respectively. Eyelets 138, 139 are each configured to receive a force transferring component, such as the lanyard 152. The eyelets 138, 139 may be configured to travel through a thickness of each of the couplings 160, 162, and may also be configured to travel through a thickness of the waistband 100. The eyelets 138, 139 may be configured in a number of arrangements, such as a single eyelet on each coupling 160, 162 and/or waistband end, or numerous eyelets on each coupling 160, 162 and/or each waistband end 102, 104. The cords 114 and 116 may be integrated into the couplings 160, 162 and may circumscribe the eyelets 138, 139 to provide a linkage between the cords 114, 116 and the couplings 160, 162.

Figure 7:
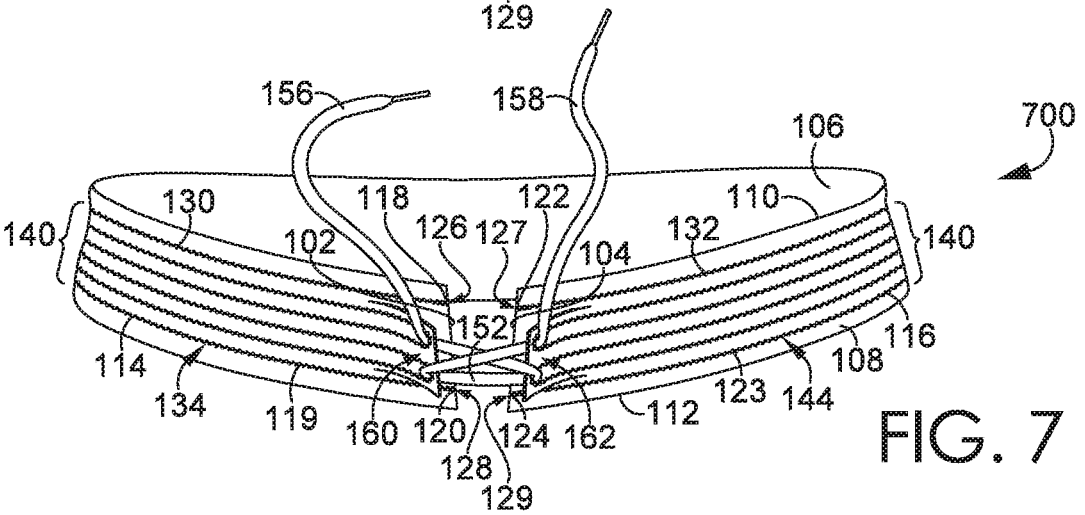
FIG. 7 depicts a front view of the waistband of FIG. 1 comprising the at least one embroidery tunnel and the exemplary first and second coupling of FIG. 6, and a lanyard coupled to the first and second coupling through a pair of eyelets, in accordance with an aspect hereof.

Looking at FIG. 7, a front view of the waistband 100 is shown in another exemplary aspect. The waistband 100 comprises embroidery tunnels 134, 144, the exemplary first and second couplings 160, 162 through which a tensioning force can be transferred to the first cord 114 and second cord 116, and a lanyard 152 coupled to the first cord coupling 160 through the pair of eyelets 138 and the second cord coupling 162 through the pair of eyelets 139. In FIG. 7, the waistband 100 is shown with the waistband first end 102 and the waistband second end 104 including the first exemplary cord coupling 160 and the second exemplary cord coupling 162, respectively. Each coupling 160, 162 can be integrated into the waistband 100, or extend from the surface of the waistband 100 comprising a distinct component attached to the outer surface 108 of the waistband 100. FIG. 7 depicts the lanyard 152 attached to the waistband first end 102 and the waistband second end 104 via the first coupling 160 and second coupling 162, respectively. More specifically, the lanyard 152 is threaded through the first coupling 160 via the first cord eyelets 138 and threaded through the second coupling 162 via the second cord eyelets 139. The lanyard first end 156 is configured to transfer a first part of the tensioning force to the first cord 114 through the first cord coupling 160 and eyelets 138, the first cord 114 configured to transfer the first part of the tensioning force applied to the first cord coupling 160 to at least a portion of the waistband 100. The lanyard second end 158 is configured to transfer a second part of the tensioning force to the second cord 116 through the second cord coupling 162 and the second eyelets 139, the second cord 116 configured to transfer the second part of the tensioning force applied to the second cord 116 to at least a portion of the waistband 100.

Figure 8:
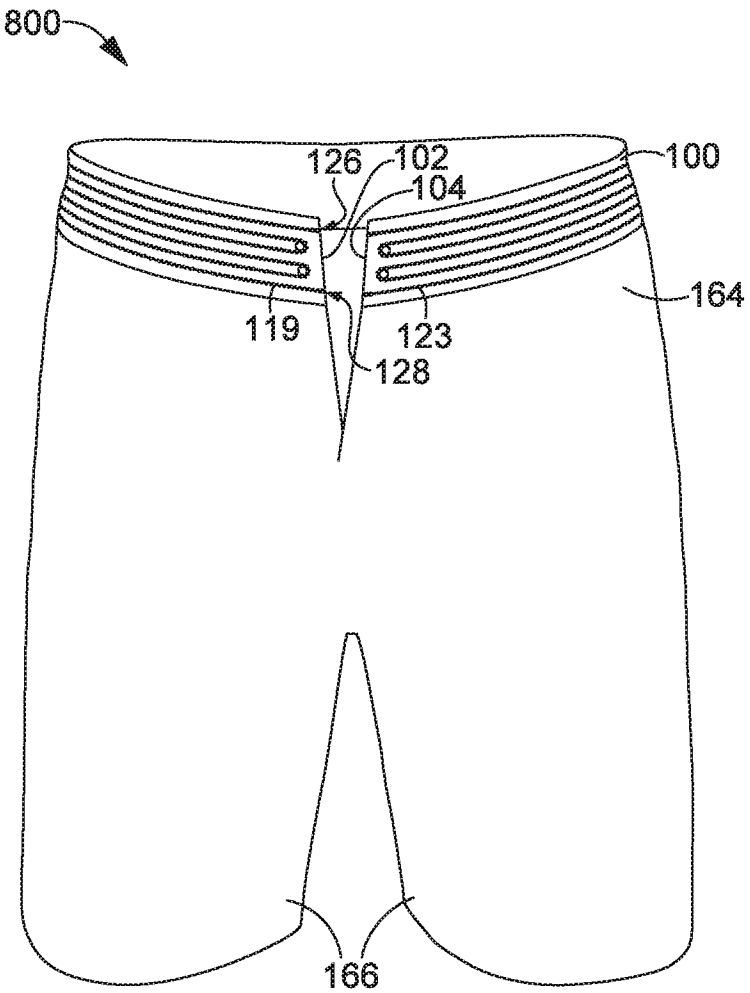
FIG. 8 depicts a front elevation view of an article of apparel incorporating the waistband of FIG. 1, in accordance with an aspect hereof.

Looking at FIG. 8, a front elevation portion of an article of apparel 800 comprising a pair of shorts is shown, in accordance with an aspect hereof. Although shorts are depicted in FIG. 8, it is contemplated that the article of apparel 800 may further comprise, pants, capris, and other types of apparel that cover the lower torso and lower extremities of a wearer. The article 800 comprises the waistband 100 featuring the first cord 114 and second cord 116 movably coupled to the waistband outer surface 108. The article of apparel 800 further comprises the waistband 100 coupled to a pelvic portion 164, the pelvic portion 164 is coupled to leg portions 166 to form a pair of shorts. The pelvic portion 164 is adapted to cover the lower part of a wearer's torso when the apparel item 800 is worn, and the leg portions 166 are adapted to cover part or all of the wearer's legs when the apparel item 800 is worn. In aspects, the pelvic portion 164 and the leg portions 166 may comprise a single piece of textile material, or alternatively, the pelvic portion 164 and the leg portions 166 may comprise multiple pieces of textile material joined together. The waistband 100 is coupled to the pelvic portion 164 at the waistband bottom edge 112 via stitching, bonding, adhesives, and the like. The waistband 100 is configured to secure the article of apparel 800 to the waist of a wearer and distribute a tensioning force applied to the first and second cords 114, 116 across at least a portion of the waistband 100. In exemplary aspects, the material used to form the waistband 100 may be the same as the material used to form the pelvic portion 164 and the leg portions 166. Alternatively, the material used to form the waistband 100 may be different than that used to form the pelvic portion 164 and/or the leg portions 166.

Figure 9:
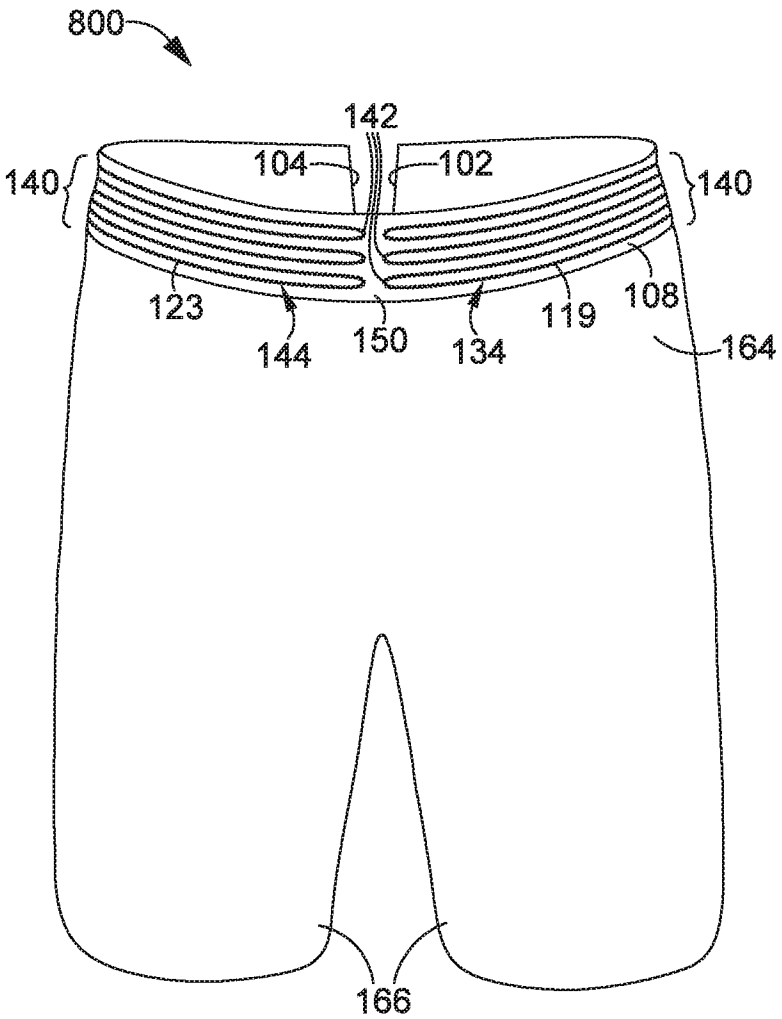
FIG. 9 depicts a rear elevation view of the article of apparel of FIG. 8 incorporating the waistband, in accordance with an aspect hereof.

Looking at FIG. 9, a rear elevation portion of the article of apparel 800 comprising the pair of shorts is shown, in accordance with an aspect hereof. The article 800 comprises the waistband 100 featuring the first and second cords 114, 116 movably coupled to the waistband outer surface 108. The article of apparel 800 comprises the waistband 100 coupled to the pelvic portion 164, the pelvic region coupled to leg portions 166. The waistband 100 is coupled to the pelvic portion 164 at the waistband bottom edge 112. The rear portion of the article 800 shows the back of the waistband 100 with the first and second half dividing portion 150 of the waistband separating the first cord embroidery tunnel 134 and second cord embroidery tunnel 144.

Figure 10:
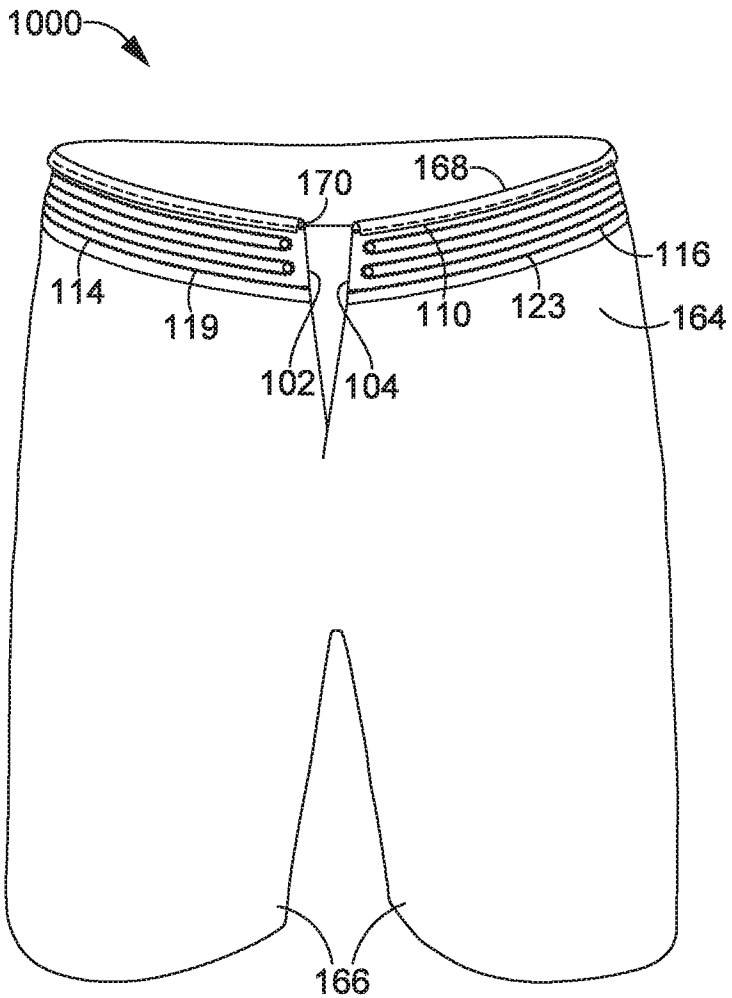
FIG. 10 depicts a front elevation view of an article of apparel showing a top edge of the waistband of FIG. 1 being folded over to form a smooth edge on the top of the waistband, in accordance with an aspect hereof.

Looking at FIG. 10, a front elevation view of an article of apparel 1000 showing the top edge 110 of the waistband 100 being folded over to form a smooth edge 168 on the top of the waistband 100 is shown, in accordance with an aspect hereof. More specifically, the top edge 110 of the waistband is folded towards the outer surface 108 of the waistband 100 and secured to the outer surface 108 using, for example, adhesive, stitching, bonding, and the like. In this configuration, a top embroidery course 170 of the plurality of substantially parallel courses 140 is covered by the folded top edge 110 of the waistband 100. This may help to secure the top embroidery course 170 such that the top embroidery course 170 does not require any tack-downs 136. The other embroidery courses 140 may comprise tack-downs 136 to prevent unraveling of the embroidery tunnels 134, 144 on the waistband outer surface 108.

Figure 11:
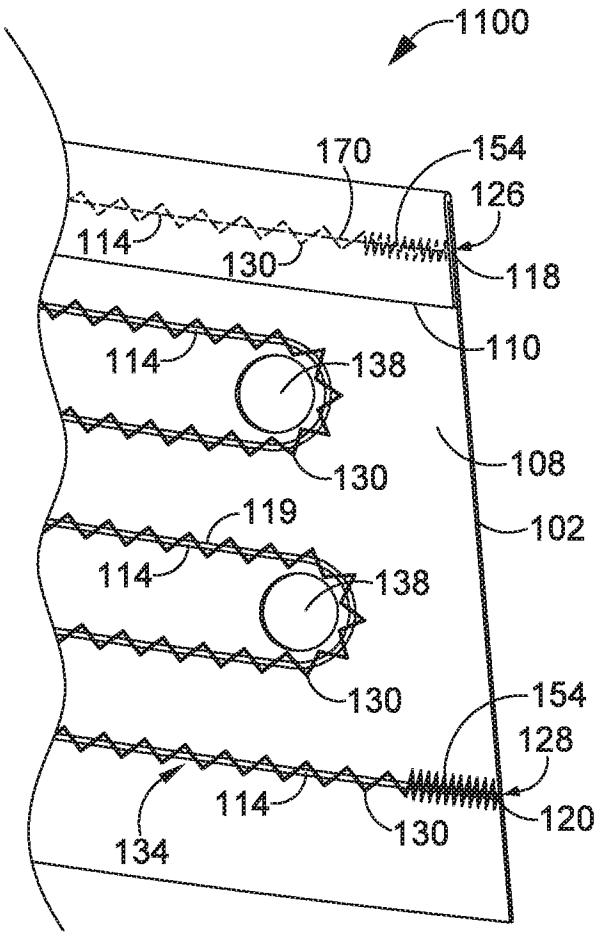
FIG. 11 depicts a close-up view of the first end of the waistband of FIG. 10 showing an embroidery tunnel, eyelets through which a lanyard can be threaded, and the folded top edge of the waistband covering the top course of the embroidery tunnel on the waistband, in accordance with an aspect hereof.

Looking at FIG. 11, a close-up view 1100 of the waistband 100 in FIG. 10 is shown, in accordance with an aspect hereof. FIG. 11 shows the folded top edge 110 of the waistband 100 covering the top course 170 of the embroidery tunnel 134 on the waistband 100. Although no tack-downs 136 are shown in FIG. 11, any number of tack-downs 136 can be coupled to the embroidery tunnel 134 in any desired frequency. Tack-downs 136 may not be required for the top course 170 since it is covered by the folded top edge 110 of the waistband 100 which provides securement. In certain aspects, the folded top edge 110 may cover multiple courses 140 of the embroidery tunnel 134, in addition to the top course 170.

Figure 12:
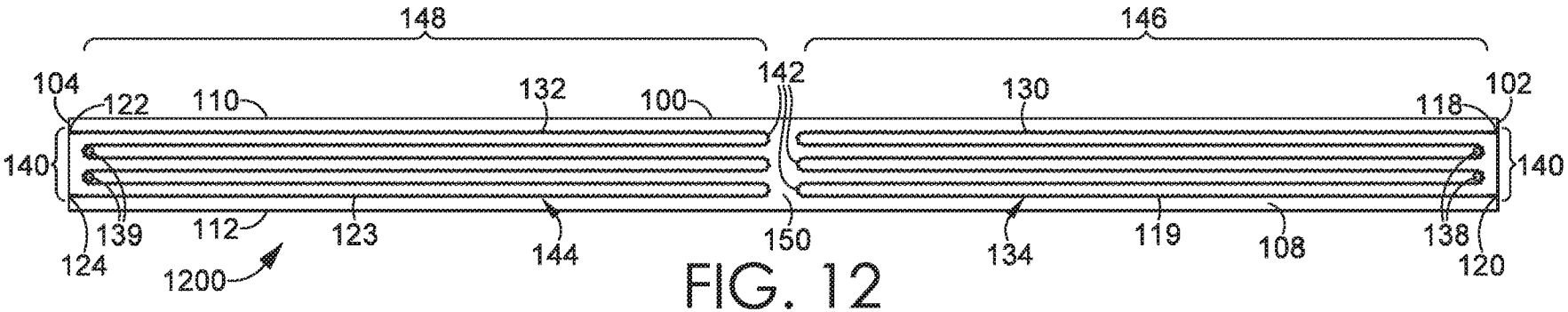
FIG. 12 depicts a front elevation view of an outer surface of a waistband in an un-assembled configuration showing a first exemplary arrangement of a cord structure with two cords and two embroidery tunnels, in accordance with an aspect hereof.
Figure 13:
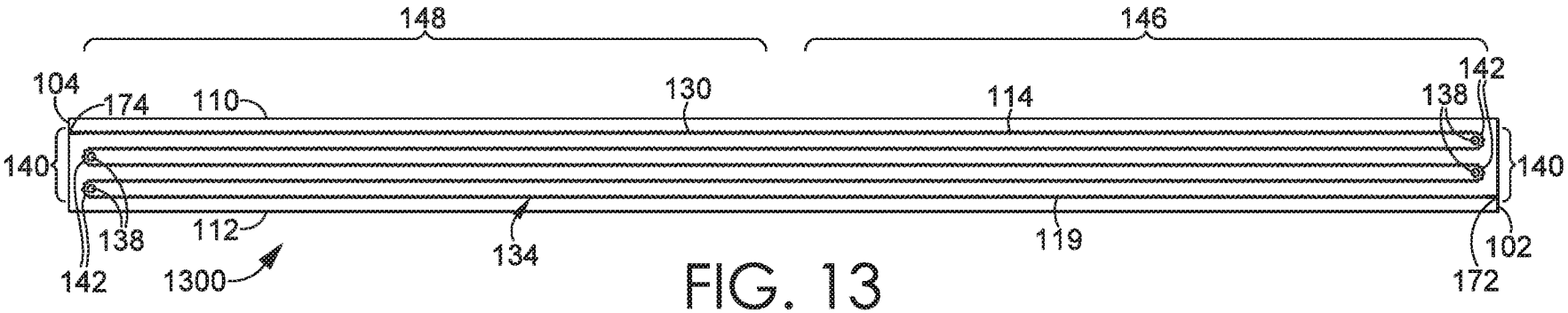
FIG. 13 depicts a view of an outer surface of a waistband in an un-assembled configuration showing a second exemplary arrangement of a cord structure including a single cord and single embroidery tunnel, in accordance with an aspect hereof.
Figure 14:
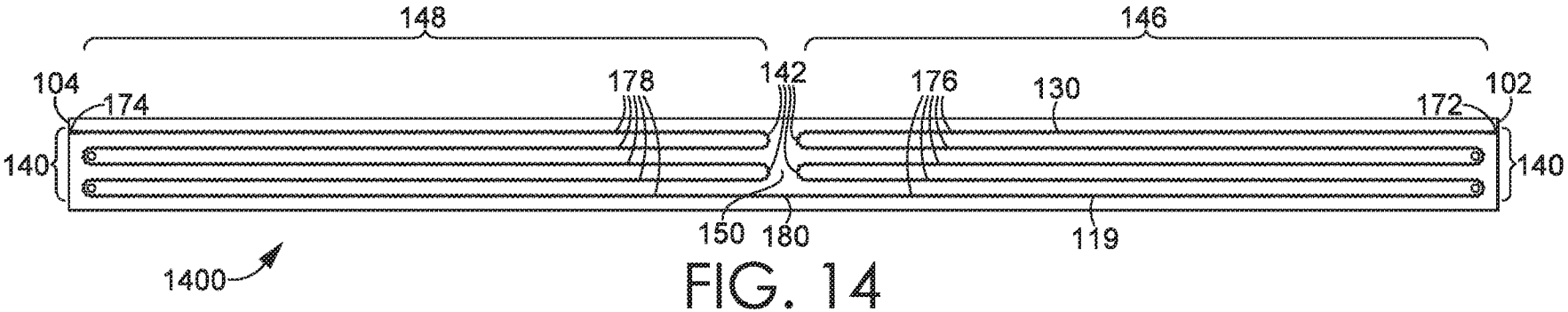
FIG. 14 depicts a view of an outer surface of a waistband in an un-assembled configuration showing a third exemplary arrangement of a cord structure with a single cord and a single embroidery tunnel, in accordance with an aspect hereof.

Turning now to FIGS. 12-14, several exemplary cord arrangements are depicted in accordance with aspects herein. Looking first at FIG. 12, a first configuration 1200 of the cord structure with two cords 114, 116 and two embroidery tunnels 134, 144 on the outer surface 108 of a waistband is shown, in accordance with an aspect hereof. The arrangement shown in FIG. 12 may comprise the same arrangement as that shown in association with the waistband 100. In FIG. 12, the waistband 100 is shown comprising a waistband first end 102 and a waistband second end 104. A first cord 114 is affixed to the waistband first end 102 at a first location 118 and a second location 120. An intervening portion 119 of the first cord 114 is movably coupled to the waistband outer surface 108 with first cord stitches 130. The first cord stitches 130 form a first embroidery tunnel 134 that forms parallel courses 140 on the first half 146 of the waistband 100. A second cord 116 is affixed to the waistband second end 104 at a first location 122 and a second location 124 with second cord stitches 132. An intervening portion 123 of the second cord 116 is movably coupled to the waistband outer surface 108. The second cord stitches 132 form a second embroidery tunnel 144 that forms parallel courses 140 on the second half 148 of the waistband 100. In the first configuration 1200, the first embroidery tunnel 134 and second embroidery tunnel 144 are separated on the waistband 100 by a dividing portion 150. The first embroidery tunnel 134 is located on the first half 146 of the waistband 100 from the waistband first end 102 to the dividing portion 150. The second embroidery tunnel 144 is located on the second half 148 of the waistband 100 from the second end 104 to the dividing portion 150. The first configuration 1200 therefore comprises a first cord 114 with stitches 130 forming a first embroidery tunnel 134 on the waistband outer surface 108, and a second cord 116 with stitches 132 forming a second embroidery tunnel 144 on the waistband outer surface 108, with each embroidery tunnel positioned on either the first half 146 or the second half 148 of the waistband 100.

Looking at FIG. 13, a second configuration 1300 that may be used in accordance with the aspects herein is depicted. In FIG. 13, the waistband comprises a waistband first end 102 and a waistband second end 104. A first cord 114 is affixed to the waistband first end 102 at a first cord first end location 172. The first cord 114 is affixed to the waistband second end 104 at a first cord second end location 174. An intervening portion 119 of the first cord 114 is movably coupled to the waistband outer surface 108 with a plurality of stitches 130 to form a first embroidery tunnel 134. The first embroidery tunnel 134 comprises a plurality of turns 142 forming a series of parallel courses 140 between the waistband top edge 110 and the waistband bottom edge 112. The courses 140 may travel substantially parallel to each other and/or parallel to the waistband top edge 110 and the waistband bottom edge 112. The courses 140 may extend across a portion of the waistband from the waistband first end 102 to the waistband second end 104, or across substantially the entire length of the waistband. In the second configuration 1300 shown in FIG. 13, the first embroidery tunnel 134 travels continuously on the waistband outer surface 108 from the first cord first end location 172 to the first cord second end location 174. The first and second ends 102, 104 of the waistband may further comprise eyelets 138, 139 for transferring a tensioning force to the first cord 114 and subsequently to the waistband. The first embroidery tunnel 134 loops around or partially circumscribes each of the eyelets 138, 139 on the outer surface 108 of the waistband. The first cord first end location 172 may be located on the waistband first end 102 at a point proximate the waistband bottom edge 112 allowing courses 140 to begin toward the bottom edge 112 of the waistband and progress towards the waistband top edge 110. The first cord second end location 174 is located at a point proximate the waistband top edge 110 such that the courses 140 end toward the waistband top edge 110. An alternate arrangement featuring the first cord first end location 172 being at a point proximate the waistband top edge 110, and the first cord second end location 174 at a point proximate the waistband bottom edge 112 is also possible. A number of arrangements can be created by one of ordinary skill in the art through selection of the first cord first end location 172 on the waistband first end 102, the first cord second end location 174 on the waistband second end 104, and the arrangement of the courses 140 on the waistband outer surface 108 remaining between the waistband first end 102 and waistband second end 104.

Looking at FIG. 14, an alternative arrangement 1400 that may be used in accordance with the aspects herein is depicted. In FIG. 14, the first cord first end location 172 and the first cord second end location 174 are located near the top edge 110 of waistband in the same vertical plane. The first cord first end location 172 and the first cord second end location 174 are located on the first end 102 and the second end 104, respectively. An intervening portion 119 is movably coupled to the waistband outer surface 108 with stitches 130 to form an embroidery tunnel 134 including a plurality of turns 142, the plurality of turns 142 forming a plurality of substantially parallel courses 140 on the waistband outer surface 108. The first cord 114 may be movably secured to the outer surface 108 by stitches 130 to form a first plurality of courses 176 on the first half 146 of the waistband 100 and a second plurality of courses 178 on the waistband second half 148 of the waistband 100, the first and second plurality of courses 176, 178 forming a continuous tunnel movably securing the intervening portion 119 of the first cord 114 between the first cord first end location 172 and the first cord second end location 174, with a first embroidery tunnel linking portion 180 traveling across the dividing portion 150 and maintaining a continuous connection between the first cord 114 from the first cord first end location 172 and the first cord second end location 174. The linking portion 180 may be located between different courses 140 in the first plurality of courses 176 and the second plurality of courses 178 to form a number of different arrangements, as would be appreciated by one skilled in the art.

Figure 15:
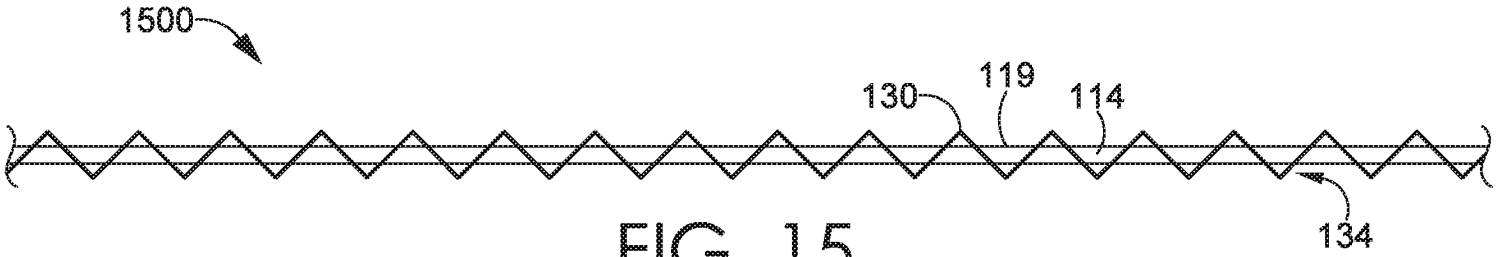
FIG. 15 depicts a close-up of a portion of a single cord with stitching used to form an embroidery tunnel on a waistband, in accordance with an aspect hereof.

Looking at FIG. 15, a close-up 1500 of a portion of the cord 114 of the waistband 100 with stitching 130 used to form an embroidery tunnel 134 is shown, in accordance with an aspect hereof. In FIG. 15, a section of the first cord 114 is shown with stitches 130 for movably securing the first cord 114 to the waistband 100 such that the first cord 114 can slide or move through the stitches 130, forming a movable coupling between the first cord 114 and the stitches 130, the stitches 130 forming the embroidery tunnel 134.

Figure 16:
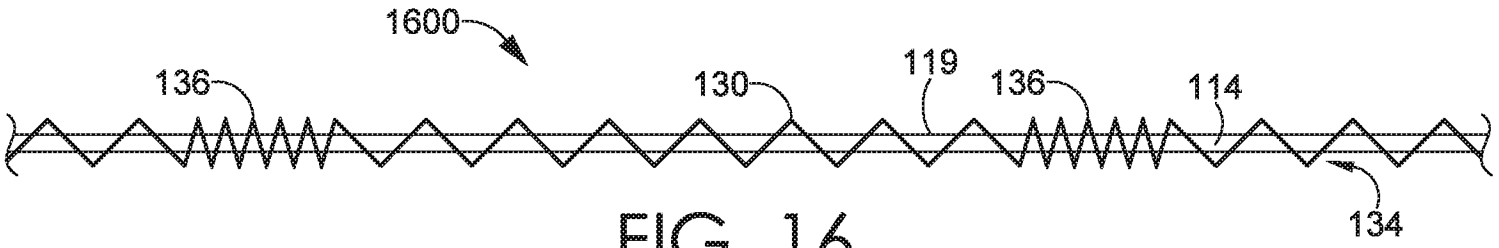
FIG. 16 depicts a close-up of a portion of a cord with stitching used to form an embroidery tunnel with intermittently spaced tack-downs on the cord to prevent unraveling of the stitching, in accordance with an aspect hereof.

Looking at FIG. 16, a close-up 1600 of a portion of the cord 114 with stitching 130 used to form an embroidery tunnel 134 with intermittently spaced tack-downs 136 in the stitching 130 is shown, in accordance with an aspect hereof. The first cord 114 is movably coupled to the waistband 100 with stitches 130, the stitches 130 forming an alternating overlay on top of the first cord 114 and the stitches 130 including a series of tack-downs 136 at intermittent locations. The tack-downs 136 are configured to prevent unraveling of a loosened part of the stitching 130, and comprise a tightly formed arrangement compared to the stitches 130. The tack-downs 136 can be positioned or alternated in a number of different configurations along the embroidery tunnel 134, as would be readily apparent to one of ordinary skill in the art.

Figure 17:
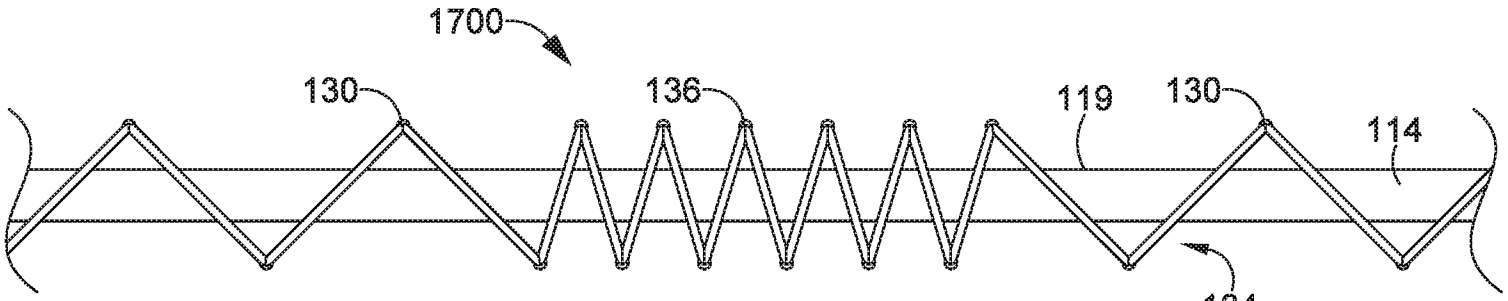
FIG. 17 depicts a close up of a tack-down configured to prevent unraveling of the stitching on the surface of the waistband, in accordance with an aspect hereof.

Looking at FIG. 17, a close-up of a tack-down 136 on the outer surface 108 of the waistband 100 is shown, in accordance with an aspect hereof. FIG. 17 provides a further close-up of the first cord 114 and stitches 130 securing the first cord 114 to the waistband 100 to form a continuous embroidery tunnel 134 with intermittently spaced tack-downs 136. The stitches 130 may cover the first cord 114 in continuous alternating zig-zag fashion right up to each tack-down 136. The stitching 130 comprising the tack-down 136 is much tighter and more concentrated to restrict unraveling or release of the embroidery tunnel stitches 130 when the embroidery tunnel 134 is damaged, loosened, or compromised, releasing the embroidery.

Figure 18:
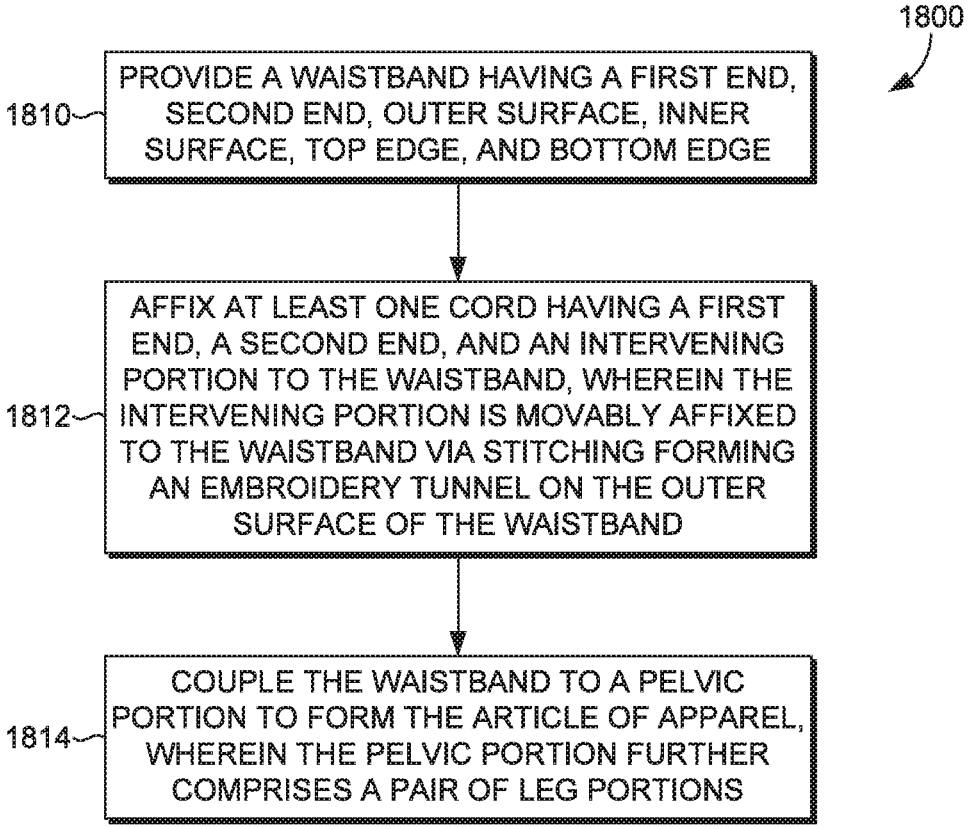
FIG. 18 depicts a flow diagram of the method for manufacturing an article of apparel that comprises a waistband having embroidery tunnels for securing a cord to the waistband, in accordance with an aspect hereof.

FIG. 18 depicts a flow diagram of the method 1800 for manufacturing an article of apparel featuring a waistband, such as the waistband 100 shown in FIG. 1, the waistband having a cord, such as the cord 114 shown in FIG. 1, movably secured to the waistband using an embroidery tunnel, such as the embroidery tunnel 134 shown in FIG. 1. The article formed from the method may comprise the article 800 described herein, or another article.

At a step 1810, a waistband is provided, the waistband having a first end, such as the first end 102 shown in FIG. 1, a second end, such as the second end 104 shown in FIG. 1, an outer surface, such as the outer surface 108 shown in FIG. 1, an inner surface, such as the inner surface 106 shown in FIG. 1, a top edge, such as the top edge 110 shown in FIG. 1, and a bottom edge, such as the bottom edge 112 shown in FIG. 1.

At a step 1812, at least one cord is affixed to the waistband, the cord having a first end, such as the first end 126 shown in FIG. 1, a second end, such as the second end 128 shown in FIG. 1, and an intervening portion, such as the intervening portion 119 shown in FIG. 1, wherein affixing the at least one cord to the waistband comprises fixing each of the first end and the second end of the cord to one of the first end or the second end of the waistband, and movably coupling the intervening portion of the cord to the waistband by stitching the intervening portion to the outer surface of the waistband, the stitching, such as the stitching 130 shown in FIG. 1, forming an embroidery tunnel on the outer surface of the waistband, the embroidery tunnel extending along the intervening portion, the embroidery tunnel stitched such that a plurality of substantially parallel courses, such as the parallel courses 140 shown in FIG. 1, are formed between the top edge and the bottom edge of the waistband, wherein the cord and embroidery tunnel are configured to transfer a tensioning force applied to the cord across at least a portion of the waistband.

At a step 1814, the waistband is coupled to a pelvic portion, such as the pelvic portion 164 shown in FIG. 8, to form the article of apparel, the pelvic portion adapted to cover a lower torso of a wearer when the article of apparel is in an as-worn configuration, the pelvic portion further comprising a pair of leg portions, such as the leg portions 166 shown in FIG. 8, adapted to cover at least a portion of legs of the wearer when the article of apparel is in the as-worn configuration.

From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and non-limiting.

What is claimed is:

1. A method of manufacturing an article of apparel, the method comprising:

movably coupling a cord to a textile using stitching, the stitching forming an embroidery tunnel on an outer surface of the textile that movably couples the cord to the outer surface of the textile, the embroidery tunnel forming a plurality of substantially parallel courses on the outer surface of the textile, the plurality of substantially parallel courses including a first course and a second course, and the embroidery tunnel formed to provide a plurality of turns that interconnect the plurality of substantially parallel courses, the plurality of turns including a first turn that interconnects the first course and the second course, wherein at least a portion of the cord is movable through the embroidery tunnel in a direction parallel to an axial direction of the embroidery tunnel, such that the cord is movable through both the plurality of substantially parallel courses and the plurality of turns of the embroidery tunnel, and wherein the cord remains within the embroidery tunnel along a length of the embroidery tunnel that includes at least a portion of the first course, at least a portion of the second course, and the first turn that interconnects the first course and the second course.

2. The method of manufacturing the article of apparel of claim 1, wherein the textile forms part of a waistband.

3. The method of manufacturing the article of apparel of claim 1, wherein the cord is secured to the textile at opposite ends of the textile.

4. The method of manufacturing the article of apparel of claim 1, further comprising:

attaching a first coupling having a first-lanyard aperture to the textile; and attaching a second coupling having a second-lanyard aperture to the textile.

5. The method of manufacturing the article of apparel of claim 1, wherein the textile comprises a woven textile.

6. The method of manufacturing the article of apparel of claim 1, wherein the textile comprises a knitted textile.

7. The method of manufacturing the article of apparel of claim 1, wherein a portion of the cord is exposed through the embroidery tunnel.

8. The method of manufacturing the article of apparel of claim 1, wherein the textile comprises a stretchable textile.

9. The method of manufacturing the article of apparel of claim 1, wherein the article of apparel comprises a lower-body article of apparel.

10. The method of manufacturing the article of apparel of claim 9, wherein the article of apparel comprises a pair of shorts.

11. A method of manufacturing an article of apparel, the method comprising:

movably coupling a cord to an outer surface of a waistband using stitching, the stitching forming an embroidery tunnel on the outer surface of the waistband that movably couples the cord to the outer surface of the waistband, the embroidery tunnel forming a plurality of substantially parallel courses on the outer surface of the waistband, the plurality of substantially parallel courses including a first course and a second course, and the embroidery tunnel formed to provide a plurality of turns that interconnect the plurality of substantially parallel courses, the plurality of turns including a first turn that interconnects the first course and the second course, wherein at least a portion of the cord is movable through the embroidery tunnel in a direction parallel to an axial direction of the embroidery tunnel, such that the cord is movable through both the plurality of substantially parallel courses and the plurality of turns of the embroidery tunnel, and wherein the cord remains within the embroidery tunnel along a length of the embroidery tunnel that includes at least a portion of the first course, at least a portion of the second course, and the first turn that interconnects the first course and the second course; and coupling the waistband to a textile formed to define a pelvic portion and a pair of leg portions.

12. The method of manufacturing the article of apparel of claim 11, wherein the waistband comprises a stretchable material.

13. The method of manufacturing the article of apparel of claim 11, wherein the waistband comprises a woven material.

14. The method of manufacturing the article of apparel of claim 11, wherein the waistband comprises a knitted material.

15. The method of manufacturing the article of apparel of claim 11, wherein the cord comprises a non-stretchable material.

16. The method of manufacturing the article of apparel of claim 11, wherein the article of apparel comprises a pair of shorts.

17. A method of manufacturing an article of apparel, the method comprising:

movably coupling a cord to an outer surface of a first textile using stitching, the stitching forming an embroidery tunnel on the outer surface of the first textile that movably couples the cord to the outer surface of the first textile, the embroidery tunnel forming a plurality of substantially parallel courses on the outer surface of the first textile, the plurality of substantially parallel courses including a first course and a second course, and the embroidery tunnel formed to provide a plurality of turns that interconnect the plurality of substantially parallel courses, the plurality of turns including a first turn that interconnects the first course and the second course, wherein at least a portion of the cord is movable through the embroidery tunnel in a direction parallel to an axial direction of the embroidery tunnel, such that the cord is movable through both the plurality of substantially parallel courses and the plurality of turns of the embroidery tunnel, and wherein the cord remains within the embroidery tunnel along a length of the embroidery tunnel that includes at least a portion of the first course, at least a portion of the second course, and the first turn that interconnects the first course and the second course; and attaching the first textile to a second textile to form the article of apparel.

18. The method of manufacturing the article of apparel of claim 17, wherein the first textile comprises a stretchable textile.

19. The method of manufacturing the article of apparel of claim 17, wherein the cord comprises a non-stretchable material.

20. The method of manufacturing the article of apparel of claim 17, wherein the article of apparel is a pair of shorts.

* * * * *